US012805656B2

(12) United States Patent
Delk

(10) Patent No.: US 12,805,656 B2
(45) Date of Patent: Nov. 24, 2026

(54) PILLOW SYSTEM

(71) Applicant: Christopher L. Delk, Overland, MO (US)

(72) Inventor: Christopher L. Delk, Overland, MO (US)

( * ) Notice: Subject to any disclaimer, the term of this patent is extended or adjusted under 35 U.S.C. 154(b) by 194 days.

(21) Appl. No.: 18/627,376

(22) Filed: Apr. 4, 2024

(65) Prior Publication Data

US 2024/0335053 A1 Oct. 10, 2024

Related U.S. Application Data

(60) Provisional application No. 63/457,075, filed on Apr. 4, 2023.

(51) Int. Cl.
*A47G 9/10* (2006.01)
*A47C 7/38* (2006.01)

(52) U.S. Cl.
CPC ..... *A47G 9/10* (2013.01); *A47C 7/383* (2013.01); *A47G 2009/1018* (2013.01)

(58) Field of Classification Search
CPC ..... A47C 7/383; A47G 9/10; A47G 2009/1018
See application file for complete search history.

(56) References Cited

U.S. PATENT DOCUMENTS 4,688,285 A * 8/1987 Roberts ..... A61G 7/05723 5/630
5,471,690 A * 12/1995 McNeil ..... A47C 7/383 D6/333
6,182,314 B1 * 2/2001 Frydman ..... A47C 20/021 606/240
6,345,401 B1 * 2/2002 Frydman ..... A47G 9/109 5/636
9,756,968 B1 * 9/2017 Gewant ..... A47C 7/383
11,432,653 B1 * 9/2022 Gormeley ..... A47C 7/383
12,144,451 B1 * 11/2024 Chen ..... D06M 15/59
2007/0204406 A1 * 9/2007 Thisse ..... A47C 7/0213 5/655.3
2012/0181834 A1 * 7/2012 Yu ..... A47C 3/16 297/344.21
2017/0095096 A1 * 4/2017 Mandell ..... A47C 15/00
(Continued)

*Primary Examiner* — Eric J Kurilla
(74) *Attorney, Agent, or Firm* — Fast Forward Law, LLC; David E. Crawford; Brian P. Klein

(57) ABSTRACT

A pillow assembly includes a bottom element having a bottom element upper surface, a bottom element lower surface opposite the bottom element upper surface, and a bottom element central opening extending downward from the bottom element upper surface. The pillow assembly includes a top element having a top element upper surface, a top element lower surface opposite the top element upper surface lower surface, and a top element central opening extending upward from the top element lower surface. The top element is adapted for positioning in stacked relation with the bottom element, so the top element central opening is vertically aligned with the bottom element central opening. The pillow assembly includes an connector configured for simultaneous receipt in the top element central opening and the bottom element central opening when the top element and bottom element are in stacked relation to selectively join the top element and the bottom element.

17 Claims, 15 Drawing Sheets

(56) References Cited

U.S. PATENT DOCUMENTS

| | | | | |
|---|---|---|---|---|
| 2020/0221880 | A1* | 7/2020 | Rogers | A47G 9/10 |
| 2021/0244210 | A1* | 8/2021 | Kluba | A61G 13/121 |
| 2022/0338639 | A1* | 10/2022 | Smidel | A61G 7/0755 |
| 2023/0347203 | A1* | 11/2023 | Morris | A47G 9/10 |
| 2024/0260769 | A1* | 8/2024 | Geschwender | A47G 9/1036 |

* cited by examiner

PILLOW SYSTEM

CROSS-REFERENCE TO RELATED APPLICATIONS

The present application claims priority to U.S. Provisional Patent Application No. 63/457,075 entitled, "PILLOW SYSTEM" filed on Apr. 4, 2023, which is hereby incorporated by reference in its entirety.

BACKGROUND

The present disclosure is directed to an ergonomic pillow system, and more particularly, to a selectively reconfigurable pillow system that accommodates multiple sleep and reclining positions and supports storage and travel.

Although a comfortable pillow that provides proper support for the head and neck, as well as spinal alignment is essential to achieving restful sleep, most prior art pillows take a "one size fits all" approach and do not adapt to the physical characteristics and needs of specific users. In addition, most prior pillows are not practical for travel, making it difficult for the user to recreate the comfort of sleeping at home when traveling. Moreover, prior pillow materials often lack durability, causing the pillows to break down over time and fail to perform consistently as they age.

Neck support provided by many prior art pillows is generally optimized for average user anatomy and is not adjustable to accommodate a broad range of potential users. Ill-fitting pillows can cause users to assume odd head positions during sleep, resulting in neck pain upon awakening. Further, the contours of these pillows do not fit the necks of many users and interfere with sleep, including falling asleep, staying asleep, and staying still while asleep.

Prior pillows often do not address the needs of users with injuries or strains, or those recovering from surgeries such as disc fusion, which eliminates motion between the fused discs, usually increasing motion between adjacent discs and potentially straining those discs, making it difficult to align the head, neck, and spine correctly using conventional pillows. Currently, most users who have these issues are left to search for a pillow combination that relieves pain and discomfort to the neck. However, even when a good combination is found, users often find it difficult to remain still so correct spinal alignment is maintained during sleep.

Because typical pillows do not offer a whole body approach to sleep, users must rely on multiple pillow types and search for a sleep position that provides comfort and support needed for restful sleep. In spite of previously available pillow options, many people still struggle to fall asleep quickly. The positions of a user's torso and legs are also important to achieving restful sleep. With proper support, certain torso and leg positions can relieve stress, tension, and pain in the back, hips, and knees. Because typical pillows do not take into account the position of the entire body during sleep, users often find they must try a variety of sleeping positions to obtain the comfort required for restful sleep.

Many pillows are not comfortable when using breathing apparatus, such as CPAP masks, and sleeping on their side. Side sleepers struggle to keep the apparatus from shifting out of position during sleep and supporting their neck and head.

Full-sized pillows commonly used at home are not convenient to pack in luggage for travel. Conversely, pillows designed for travel frequently sacrifice support for portability. Without pillows from home, users struggle to recreate pillow configurations used at home, frequently resulting in suboptimal sleep when traveling.

Respiration (i.e., autonomic breathing), heart rate, and blood pressure are controlled by the medulla oblongata, an area of the brain located near the base of the skull and top of the neck. To obtain restful sleep, respiration and heart rate must slow and blood pressure must decrease from active levels. Relaxing these subconscious functions of the body more quickly after lying down improves the likelihood of falling asleep faster. Pressure applied on the neck by a pillow can result in discomfort or even pain and can also cause pressure on the base of the skull where the medulla is located, potentially interfering with the relaxation of body functions needed to fall asleep. Conversely, it is believed that reduced pressure on the medulla supports falling asleep faster.

SUMMARY

In one aspect, the present disclosure includes a pillow assembly, comprising a bottom element having a bottom element upper surface, a bottom element lower surface opposite the bottom element upper surface, and a bottom element central opening extending downward from the bottom element upper surface. The pillow assembly also includes a top element having a top element upper surface, a top element lower surface opposite the top element upper surface lower surface, and a top element central opening extending upward from the top element lower surface. The top element is adapted for positioning in stacked relation with the bottom element, so the top element central opening is vertically aligned with the bottom element central opening. The pillow assembly further comprises an element connector configured for simultaneous receipt in the top element central opening and the bottom element central opening when the top element and bottom element are in stacked relation to selectively join the top element and the bottom element.

In another aspect, the present disclosure includes a pillow assembly, comprising a generally circular bottom ring having a bottom ring upper surface, a bottom ring lower surface opposite the bottom ring upper surface, and a generally circular bottom ring central opening extending through the bottom ring from the bottom element upper surface to the bottom ring lower surface. In addition, the pillow assembly includes a generally circular top ring having a top ring upper surface, a top ring lower surface opposite the top ring upper surface, and a generally circular top ring central opening extending through the top ring from the top ring upper surface to the top ring lower surface. The pillow assembly also includes a ring connector having a cylindrical portion extending between a top flange and a bottom flange. The cylindrical portion is selectively insertable simultaneously in the bottom ring central opening and the top ring central opening when the top ring is stacked above the bottom ring.

Other aspects of the present disclosure will be apparent in view of the following description and claims.

BRIEF DESCRIPTION OF DRAWINGS

This description includes disclosure of the present system by way of exemplary, non-limiting examples illustrated in the accompanying drawings.

Corresponding reference characters indicate corresponding parts throughout the drawings.

DETAILED DESCRIPTION

Figure 1:
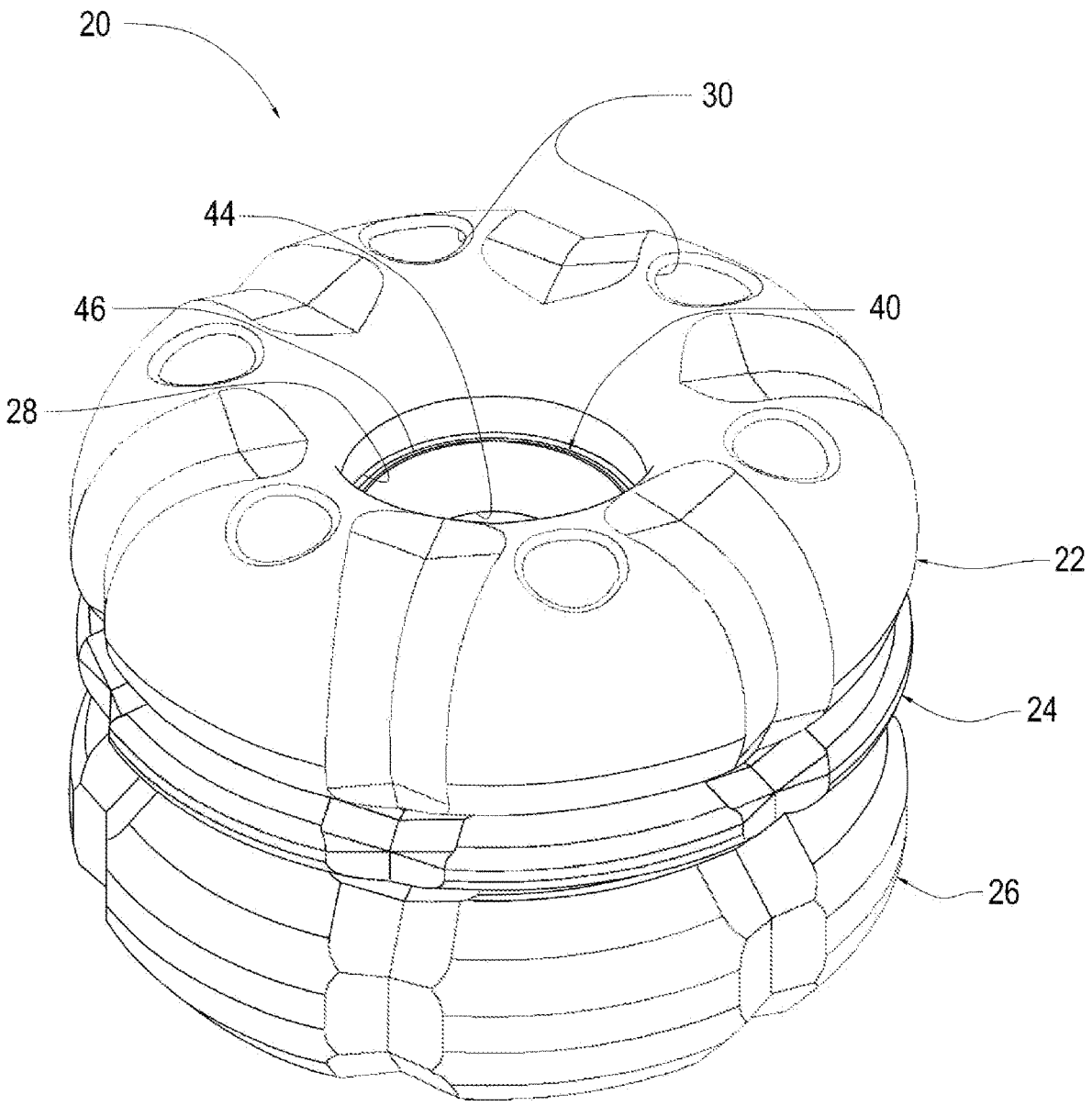
FIG. 1 is a perspective of a first example of a pillow assembly.

FIG. 1 illustrates a pillow assembly designated in its entirety by the reference number 20. The illustrated pillow assembly 20 comprises an upper ring or top layer, generally designated by 22, a middle ring or middle layer, generally designated by 24, and a lower ring or bottom layer, generally designated by 26, assembled to provide a central opening 28. Although the rings may be formed from other materials, the illustrated rings 22, 24, 26 are formed from foam having suitable compressibility and resiliency. In the illustrated example, the upper ring 22 is formed from a relatively compressible foam to provide a softer, more comfortable top layer or cushion. The middle ring 24 is formed from a more resilient foam to ensure the ring returns to its uncompressed thickness, and the lower ring 26 is formed from a firmer foam (i.e., less compressible than the middle and upper rings) to provide a stable base for the assembly 20. When assembled, the upper ring 22, the middle ring 24, and the lower ring 26 are arranged in a stack as shown.

Figure 2:
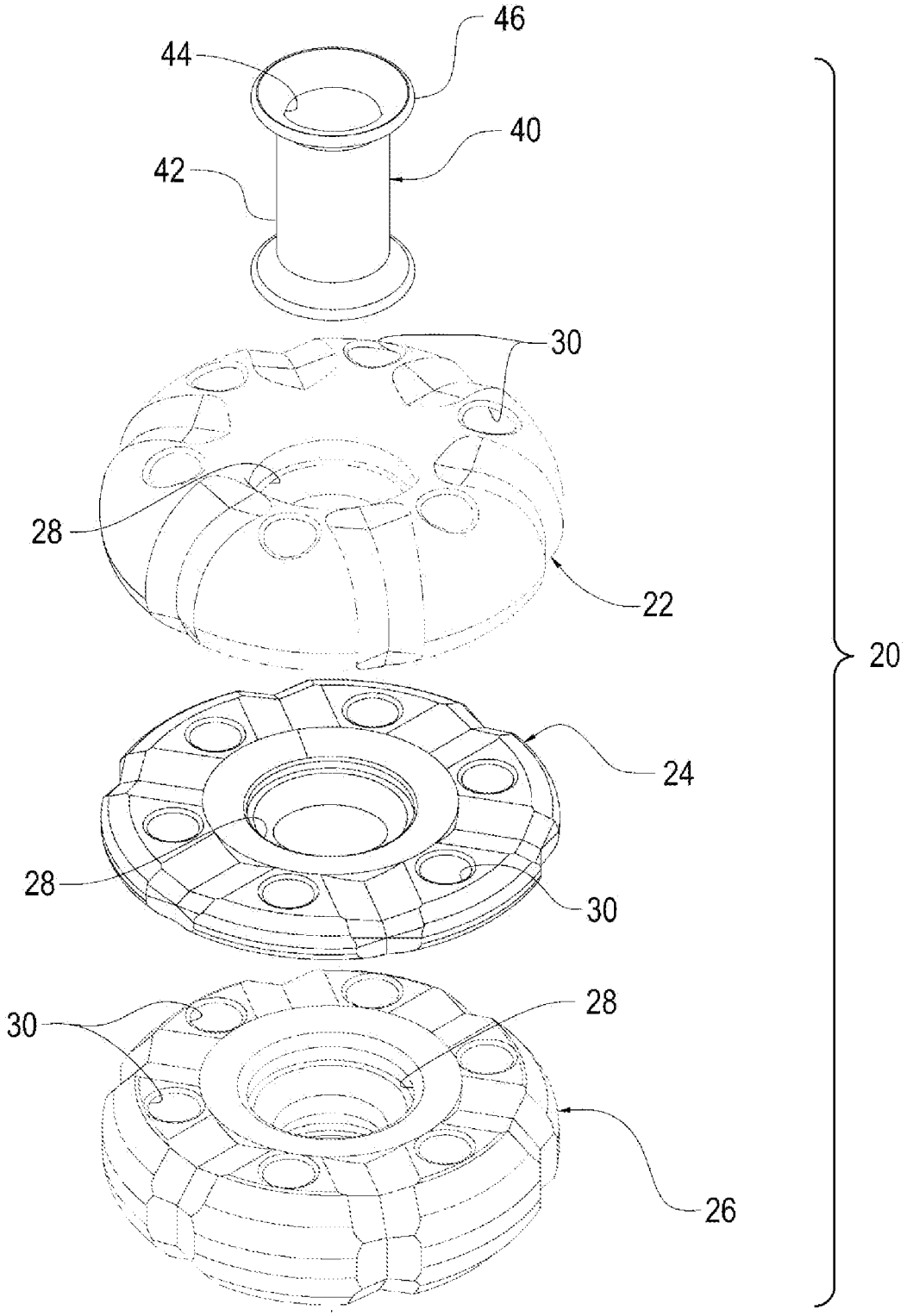
FIG. 2 is a separated perspective of the first example.

As shown in FIG. 2, each of the rings 22, 24, 26 has a central opening 28 and a plurality of air passages 30 spaced around its central opening. Although other numbers and arrangements of air passages are contemplated, the illustrated rings 22, 24, 26 each have six evenly spaced passages 30 surrounding its central opening 28. As will be appreciated, the openings and passages 28, 30 allow air to pass through the assembled pillow 20. In the illustrated example, the openings and passages 28, 30 of each of the rings 22, 24, 26 are aligned vertically when the rings are connected, forming spaces for receiving accessories, such as a small night light, a scent producing device, or an audio device (none of which are shown). The rings 22, 24, 26 are stacked vertically and connected by a ring connector or hub, generally designated by 40, to form the pillow assembly 20.

Like the individual rings 22, 24, 26, the pillow assembly 20 has a generally circular, annular shape. The central openings 28 of the rings 22, 24, 26 have a common minimum diameter and are arranged to minimize contact with soft tissue areas of the user's face. Instead, the pillow assembly 20 focusses contact on the skeletal parts of the user's face. Further, the circular ring shape eliminates contact between the pillow assembly 20 and the user's neck when the user's skull is centered on the assembly, allowing proper head, neck, and spinal alignment. Because the pillow assembly 20 does not contact the user's neck, a space is created under the user's neck from the head to the shoulders. The space under the user's neck reduces pressure on the user's neck and reduces pressure on the area corresponding to the user's medulla oblongata. Although not wishing to be bound by a particular theory, it is believed that eliminating neck pressure when sleeping permits the medulla to relax more quickly, reducing respiration, heart rate, and blood pressure and allowing the user to achieve a sleep state more quickly.

Figure 3:
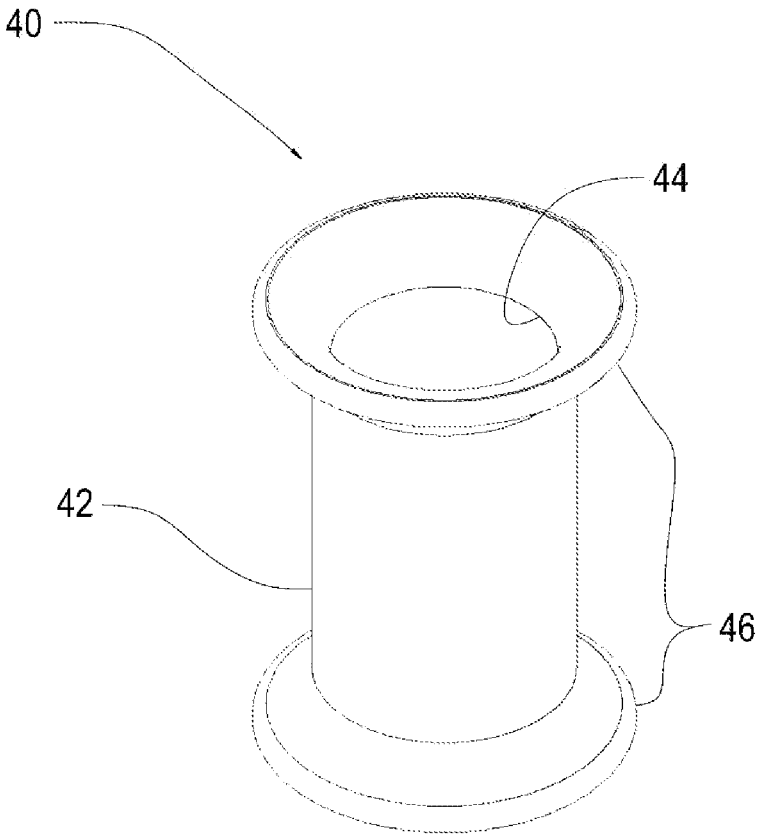
FIG. 3 is a perspective of a ring connector of the first example.

As shown in FIG. 3, the hub 40 includes an elongated tube or column 42 having a hollow cylindrical interior 44 and a tapered flange or rim 46 at each end. The hub 40 of the illustrated is formed from a flexibly elastic material, allowing the column 42 to deform and the rim 46 to flex when connecting and disconnecting the rings 22, 24, 26. When assembled, the rims 46 engage the upper and lower rings 22, 26 to hold the assembly 20 together.

Figure 4A:
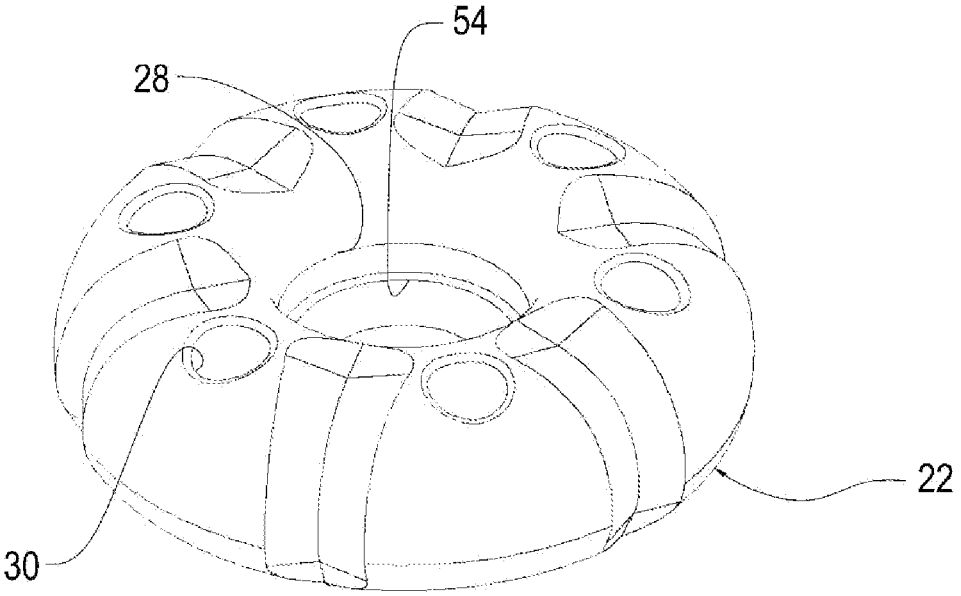
FIG. 4A is a top perspective of an upper ring of the first example.
Figure 4B:
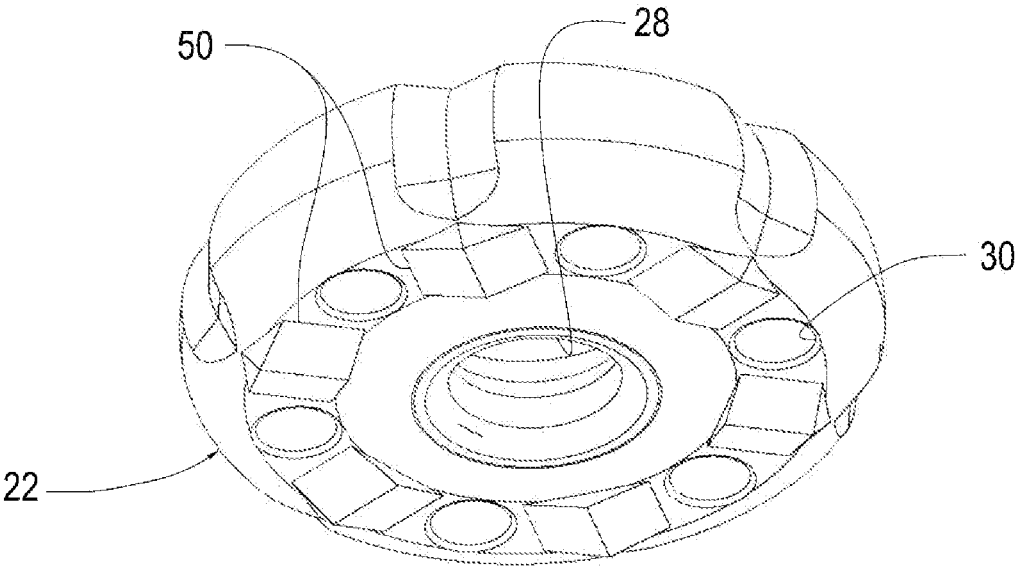
FIG. 4B is a bottom perspective of the upper ring.
Figure 5:
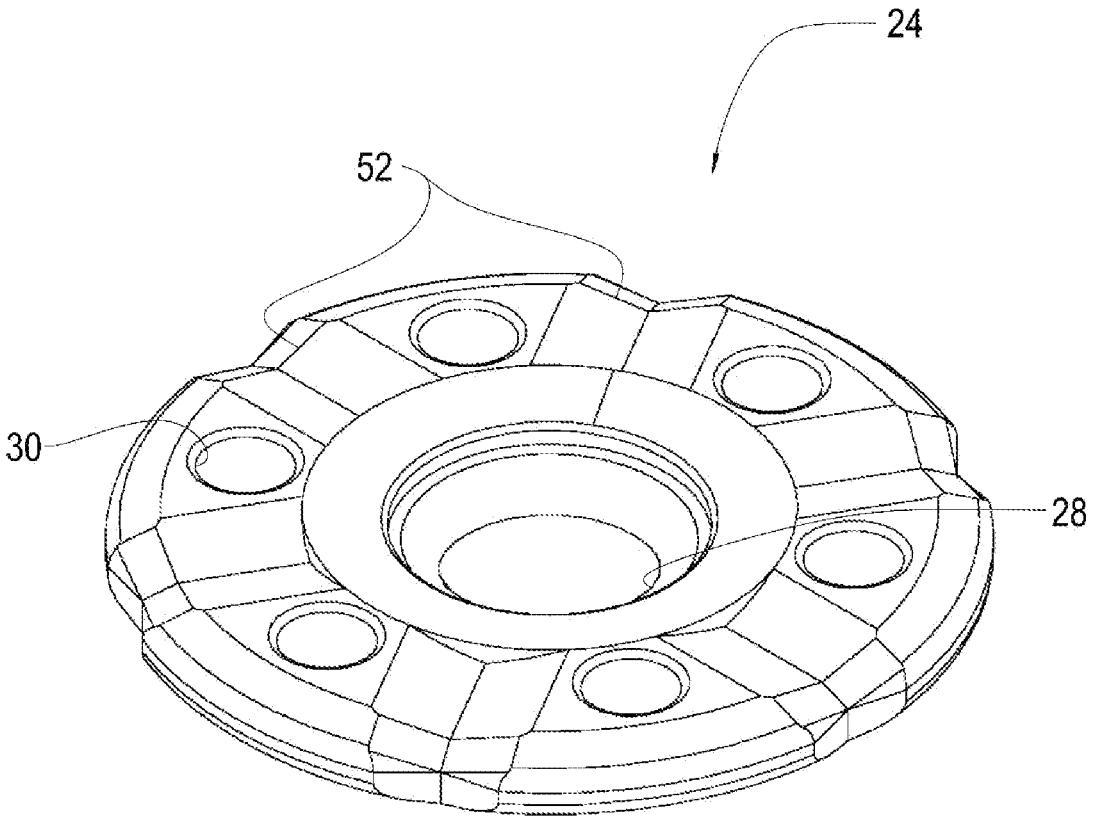
FIG. 5 is a perspective of a middle ring of the first example.
Figure 6:
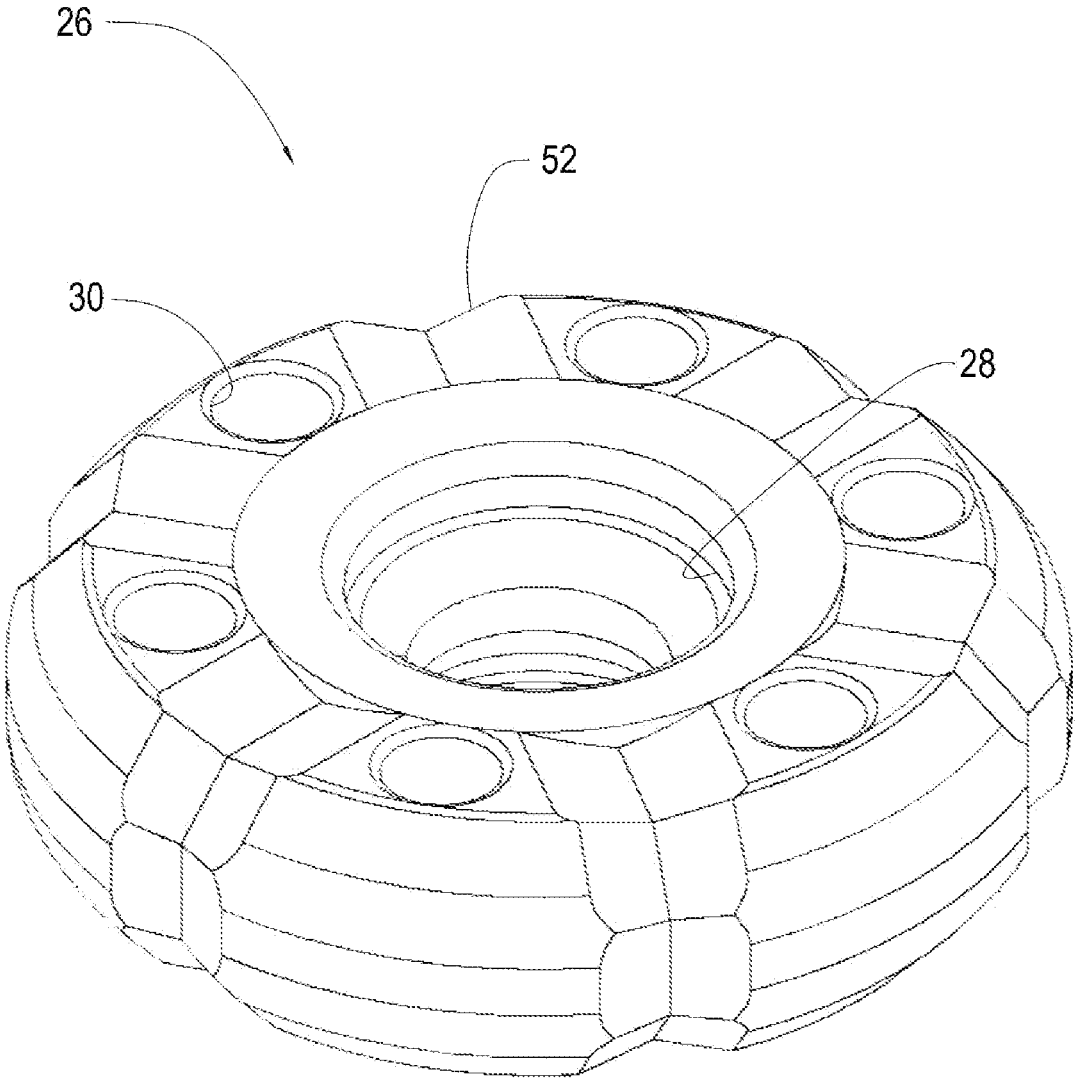
FIG. 6 is a perspective of a lower ring of the first example.

FIGS. 4-6 show that the upper, middle, and lower rings 22, 24, 26 each have radially-extending grooves and/or ridges between the passages 30. More particularly, FIG. 4B shows the upper ring 22 has faceted radial ridges 50 on its lower face that are adapted to engage corresponding faceted radial grooves 52 on an upper face of the middle ring 24 as shown in FIG. 5. Similar to the upper ring 22, the middle ring 24 has faceted radial ridges 50 (not shown) on its lower face adapted to engage corresponding faceted radial grooves 52 on an upper face of the lower ring 26 as shown in FIG. 6. Alternatively, the radial ridges 50 on the upper ring 22 can selectively engage the radial grooves 52 of the lower ring 26 to create a shorter pillow assembly. The interlocking ridges 50 and grooves 52 on the rings 22, 24, 26 maintain alignment of the openings and passages 28, 30 and prevent each ring from moving radially or circumferentially relative to the others when connected by the hub 40 so the assembly 20 maintains its annular shape.

As further shown in FIGS. 4A and 4B, the central opening 28 of the upper ring 22 includes a recessed land or ledge 54 that is shaped to engage the rim 46 of the ring connector 40 when the pillow is assembled as shown in FIG. 1. Because the ledge 54 is recessed, the rim 46 does not protrude from the central opening 28 nor contact the user's head when using the pillow assembly 20. The upper ring 22 may be made from soft latex foam or other resilient cushioning material to provide comfort during use. More particularly, the illustrated upper ring 22 is made from a gel-infused memory foam material to improve user comfort. The memory foam provides softness, resilience, and durability, and the infused gel offers additional cooling properties to enhance effectiveness of the passages 30. The memory foam also allows the upper ring 22 to be compressed to a smaller volume suitable for packing in luggage for travel or backpacking. The illustrated upper ring 22 has a nominal height of about three inches. It is envisioned the upper ring may alternatively have other heights (e.g., 2½ inch) to accommodate users of different sizes and preferred sleep postures.

As shown in FIG. 5, the middle ring 24 is made from semi-firm latex foam or other resilient cushioning material so the ring resiliently expands to lift the user's head to align the head, neck, and spine correctly during sleep. Depending upon a user's anatomy, the middle ring 24 may be omitted or multiple middle rings can be used in the stacked pillow assembly 20 to achieve a suitable overall thickness for the user. As previously mentioned, the ridges 50 formed on the lower faces of the upper ring 22 and middle ring 24 have identical shapes, and the grooves 52 on the upper faces of the middle ring 24 and lower ring 26 have identical shapes. Thus, the middle ring 24 may be omitted and the upper ring 22 joined directly with the lower ring 26, or multiple middle rings 24 may be stacked between the upper ring 22 and the lower ring 26. As will be appreciated, ring connectors having different lengths may be made to join pillow systems comprising various numbers of middle rings 24. The middle ring 24 can alternately be used in the multiple pillow assembly configurations to provide support beyond head, neck, and spinal alignment. The middle ring 24 is softer than the lower ring 26 to allow some compression during sleep but does not flatten completely. As will be appreciated, the short height of the middle ring 24 permits convenient packing into luggage for travel.

As illustrated in FIG. 6, the lower ring 26 serves as a structural base for the pillow assembly 20 and is made of firm latex foam or other resilient cushioning material to provide durability and a consistent, predictable performance over time. The firmness of the lower ring 26 permits minimal compression, allowing the pillow assembly 20 to maintain its intended thickness during sleep or when reclining or otherwise relaxing.

The pillow assembly 20 promotes unrestricted breathing because the upper ring 22 compresses to comfortably support the user's head, but the relative firmness of the middle and lower rings 24, 26, respectively, prevent the head from sinking into the pillow assembly 20. Further, when the user's head is supported by the upper ring 22, the central opening 28 of the pillow assembly 20 provides a space below the user's face, allowing breathing apparatus such as a CPAP mask to be used during sleep without the apparatus being dislodged or its tubing being pinched.

Figure 7:
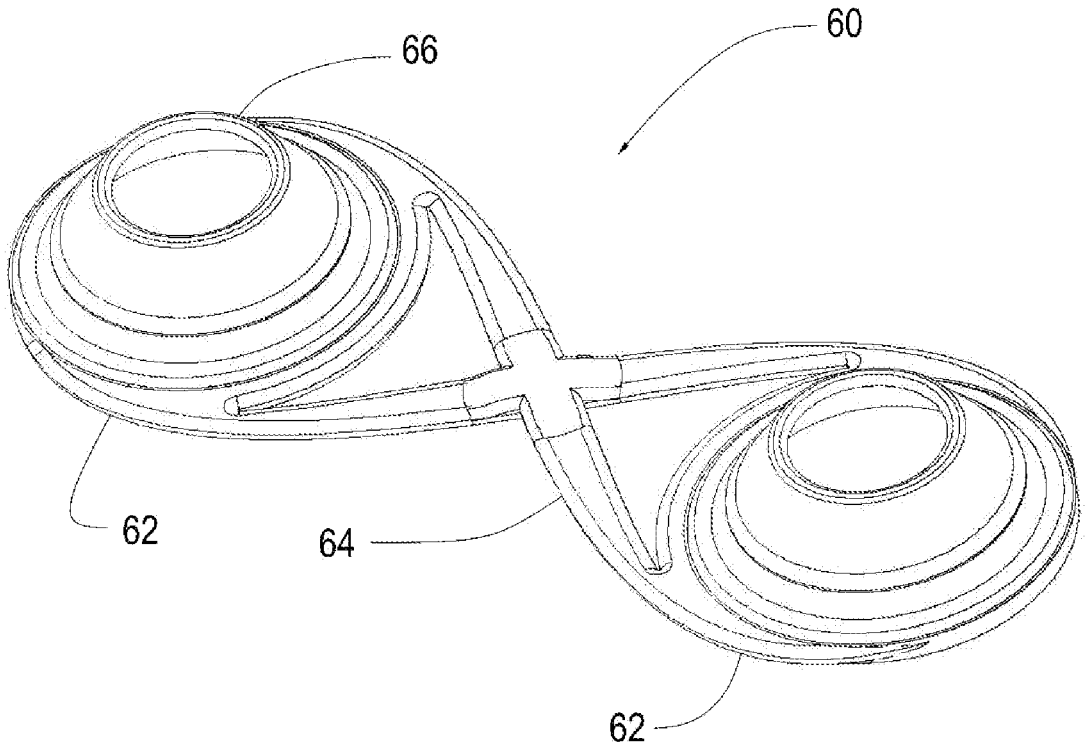
FIG. 7 is a perspective of a multi-pillow connector.
Figure 8A:
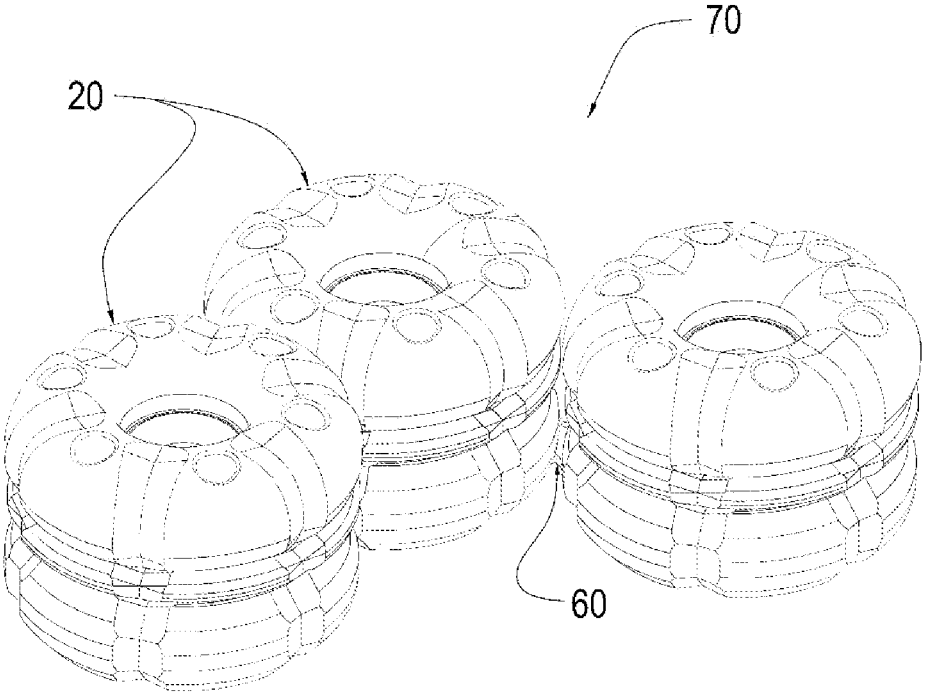
FIG. 8A is a perspective of a first collection of pillows joined by multi-pillow connectors and arranged in a first configuration.
Figure 8B:
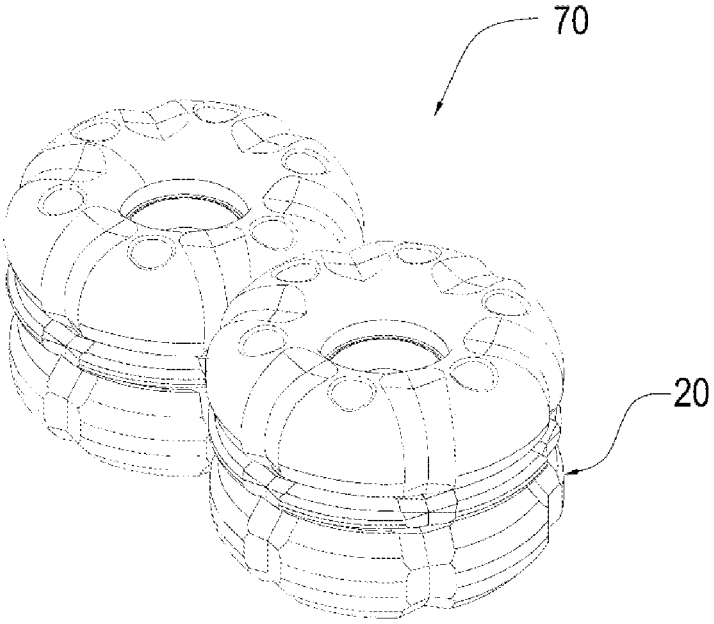
FIG. 8B is a perspective of a second collection of pillows joined by a multi-pillow connector and arranged in a second configuration.

Pillow assemblies 20 can be laterally joined using a multi-pillow connector, generally designated by 60 in FIG. 7. The connector 60 consists of two base portions 62 joined by a flexible central frame 64. The frame 64 is generally X-shaped, providing rigid in-plane support but allowing the base portions 62 move out-of-plane relative to each other. Thus, the connector 60 can be folded in half for storage or travel. Each base portion 62 has a tapered plug 66 that may be inserted in a central opening 28 of adjacent pillow assemblies 20 to create a larger pillow assemblage 70 as shown in FIGS. 8A and 8B. The tapered plugs 66 of different connectors 60 may also be stacked. Thus, if a plug 66 of a first connector 60 is already inserted in the central opening 28 of one assembly 20, a second connector may be connected to that assembly by stacking one plug of the second connector inside the plug already in the central opening of the assembly. The pillow connector 60 allows multiple pillow assemblies 20 to be joined in a variety of configurations to offer versatility for the user. The connector 60 permits pillow assemblies 20 to be joined to enlarge a lateral footprint of the overall pillow system and allows pillow assemblies to be joined in a variety of shapes to provide the user additional support and comfort for various sleeping and relaxing positions. As will be appreciated, the relatively small sizes of the components forming the pillow assembly 20 and pillow assemblages 70 facilitate packing by allowing the components to be disassembled and positioned in luggage to fill multiple smaller voids rather than making space for a single larger article. Further, when the components are reassembled, the resulting pillow assemblage configuration may be identical to that used at home so similar sleeping positions may be achieved while traveling. The illustrated connector 60 is formed from a molded flexible rubber material.

Figure 9:
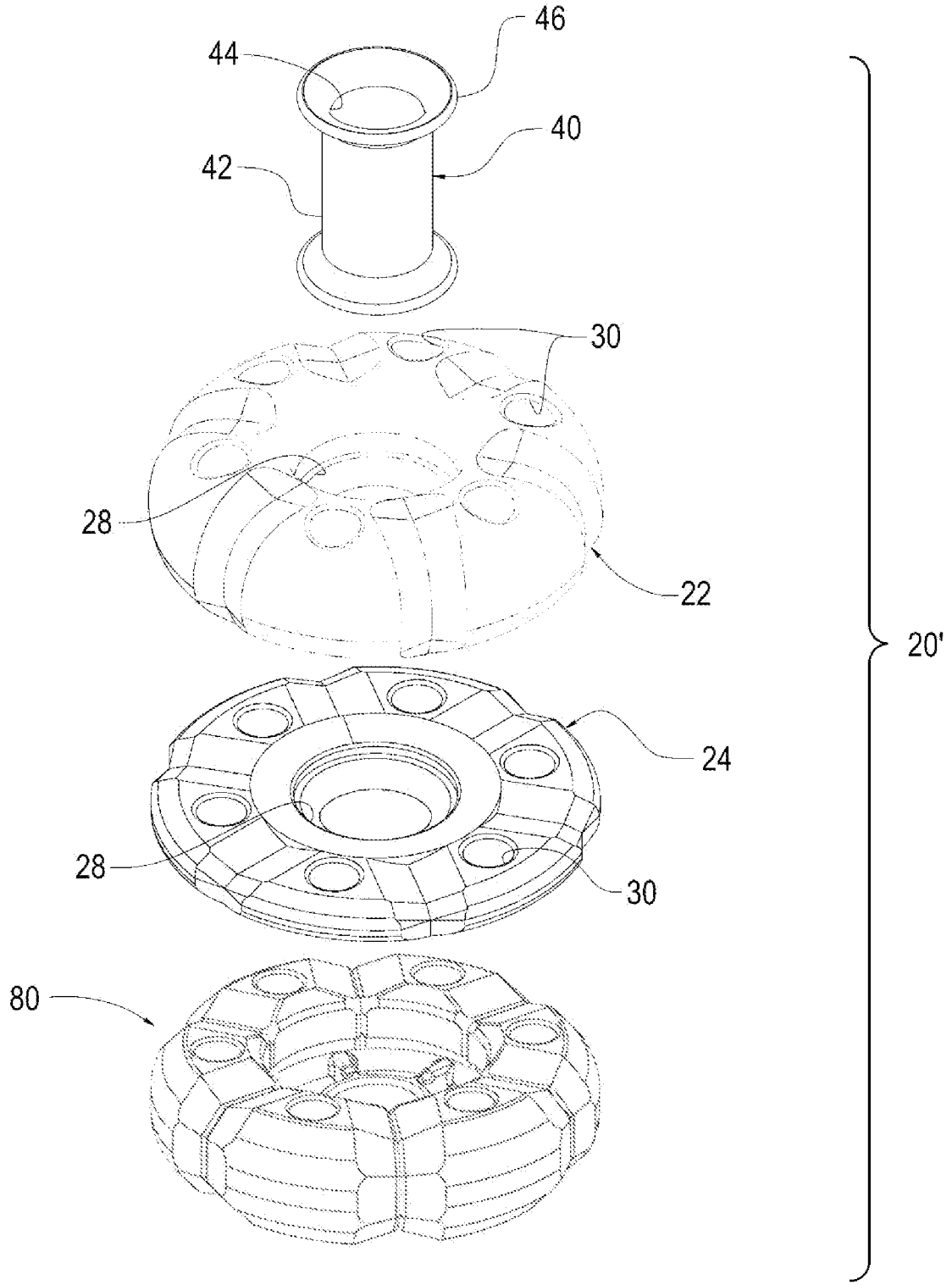
FIG. 9 is a separated perspective of a second example of a pillow.
Figure 10:
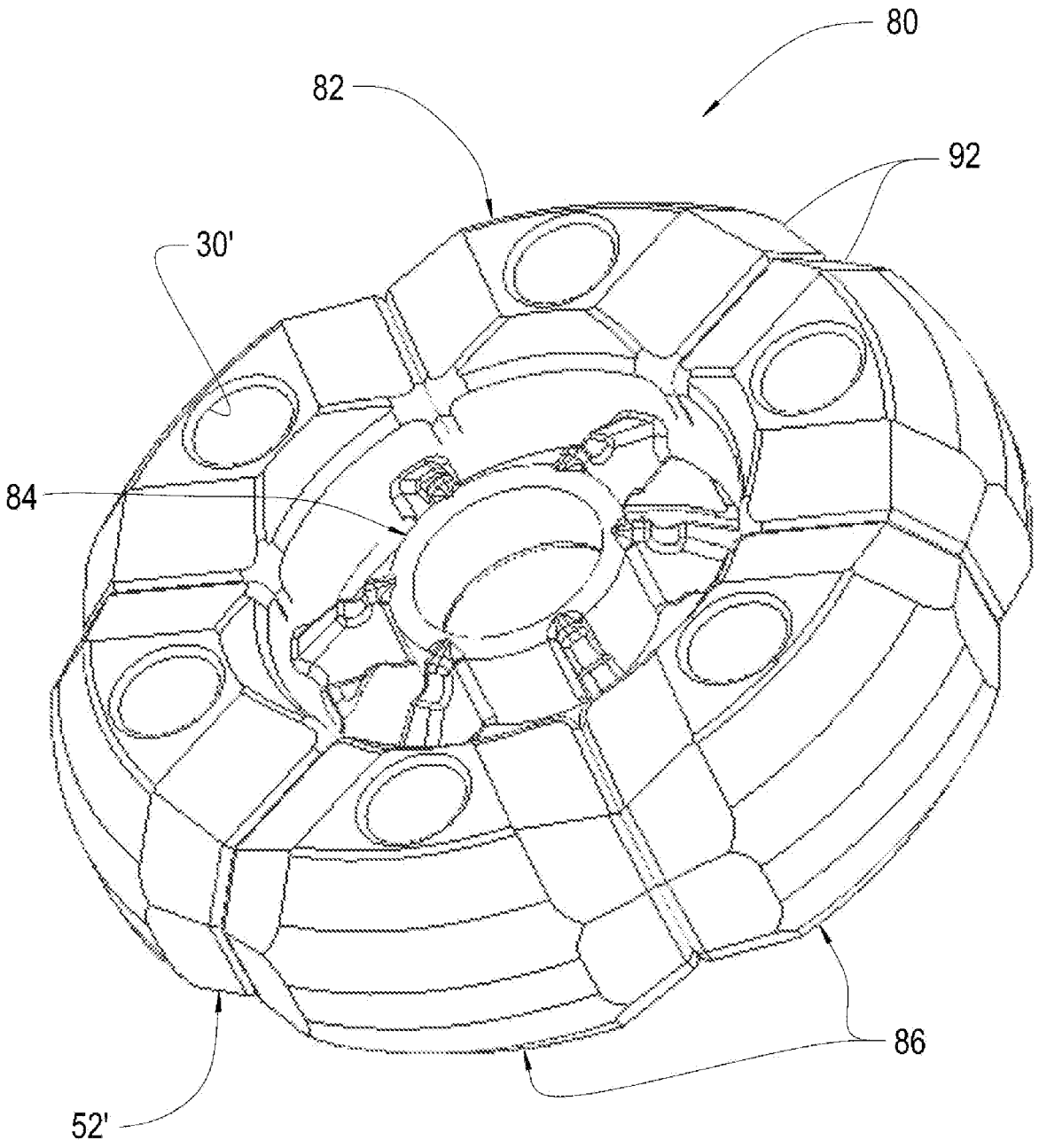
FIG. 10 is a perspective of a lower ring assembly of the second example.
Figure 11:
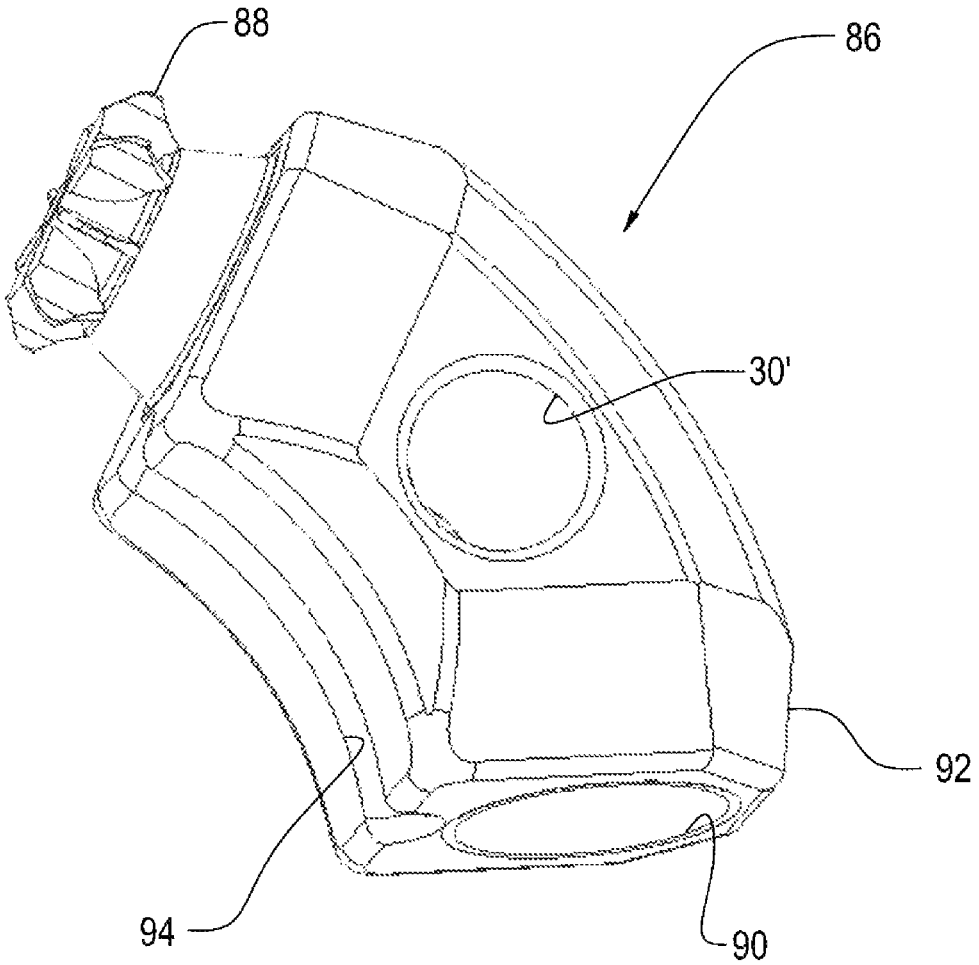
FIG. 11 is a perspective of a segment of a cushion of the lower ring assembly of the second example.
Figure 12:
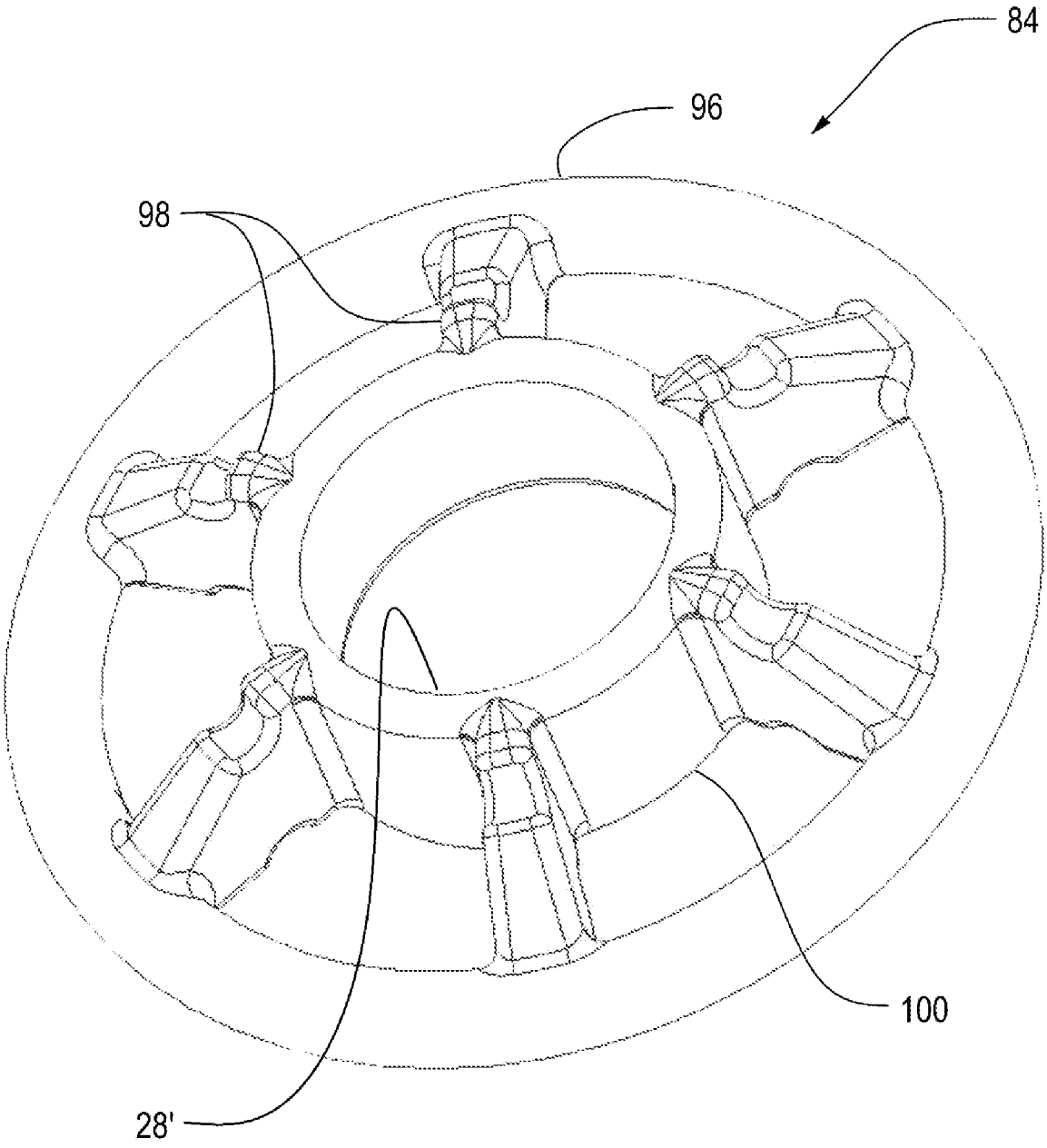
FIG. 12 is a perspective of a base frame of the lower ring assembly of the second example.

FIG. 9 illustrates a second example of a pillow assembly 20' that is particularly adapted for travel. The travel pillow assembly 20' has an overall size and shape similar to those of the pillow assembly 20 of the first example described above. The travel assembly 20' has an upper ring 22, a middle ring 24, and a hub 40 that are identical to those of the first example. A lower ring assembly, generally designated by 80, is used in the pillow assembly 20' of the second example instead of the lower ring 26 used in the pillow assembly 20 of the first example described above. As illustrated in FIG. 10, the lower ring assembly 80 generally comprises an upper assembly, generally designated by 82, and a base, generally designated by 84. The upper assembly 82 consists of six segments, generally designated by 86, as shown in FIG. 11. Each segment 86 includes an air passage 30' that forms one of the air passages of the upper assembly 82. One end of the segment 86 includes a stub connector 88 and another end has a socket 90 configured for receiving the stub connector of an adjacent segment. In addition, the ends of each segment 86 have tapering surfaces 92 forming a groove, generally designated by 52', similar to the grooves 52 formed in the lower ring 26 of the first example. Further, a circumferential groove 94 is formed along an inner face of each segment 86. When the segments 86 are joined by inserting the stub connector 88 of each segment into the socket 90 of the adjacent segment, the grooves 94 form a continuous circular groove extending inside the upper assembly 82. The groove 94 engages an outer rim 96 of the base 84. As shown in FIG. 12, the base 84 of the lower ring assembly 80 has six equally spaced spokes 98 supporting the rim 96. These spokes 98 extend radially inward from the outer rim 96 to an inner rim 100. As will be appreciated, the inner rim 100 has an opening 28' for receiving the hub 40 when forming the pillow assembly 20' of the second example.

Figure 13:
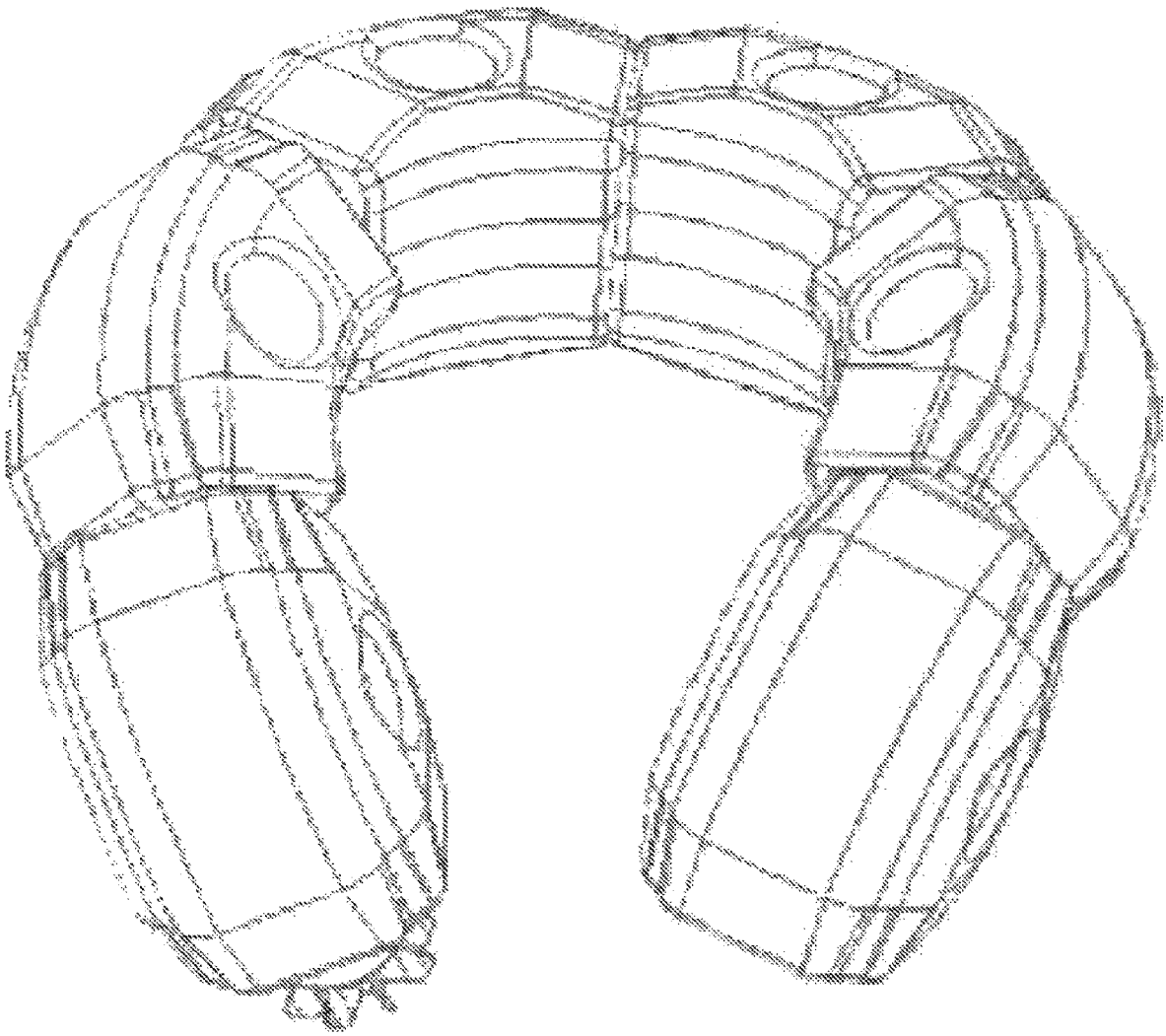
FIG. 13 is a perspective of the cushion of the lower ring assembly of the second example in an alternative configuration.

One advantage of the lower ring assembly 80 compared to the lower ring 26 of the pillow assembly 20 of the first example is that the lower ring assembly of the pillow assembly 20' of the second example may be disassembled into smaller components than the lower ring of the first example to facilitate packing in luggage. Moreover, the upper assembly 82 may be reconfigured for use as a neck pillow as shown in FIG. 13. When the upper assembly 80 is used as a neck pillow, the base 84 is conveniently smaller facilitating packing in luggage. Those skilled in the art will appreciate that the reconfigured upper assembly 82 would be available for supporting a user's head while sleeping upright in a seat. To reconfigure the segmented upper assembly 82, the user rotates adjacent segments 86 relative to each other. The plug 88 and socket 90 construction of the segments 86 facilitates rotating adjacent segments. This construction also enables segments 86 to be selectively disassembled from the upper assembly 82 so that fewer than six segments may be used if desired. Further, the construction enables the upper assembly 82 to be split and positioned around a user's neck before rejoining the segments so the upper assembly surrounds the user's neck. Similarly, a split upper assembly may be rejoined around a luggage handle to allow the upper assembly to be joined to carry-on luggage.

A third example of a pillow assembly (not shown) is envisioned in which one or more components of the pillow assembly are manufactured as inflatable cushions. As will be appreciated, inflatable cushions permit the components to be deflated for storage, packing in luggage or backpacks, or shipping to a consumer or retailer. In some examples, the inflatable cushions could be manufactured from polyvinyl chloride material using conventional processes.

In a fourth example (not shown), it is envisioned that the elongated column of the hub that holds assembled rings together may be made from a spandex, elastic, or similar stretch material. In this fourth example, the flanges at each end of the column would be molded separately and attached to the opposite ends of the column. It is envisioned that the hub of the fourth example could be sufficiently elastic that a single hub could be used to join an upper ring to a lower ring, to join an upper, middle, and lower ring, or to join an assembly having multiple middle rings.

Figure 14:
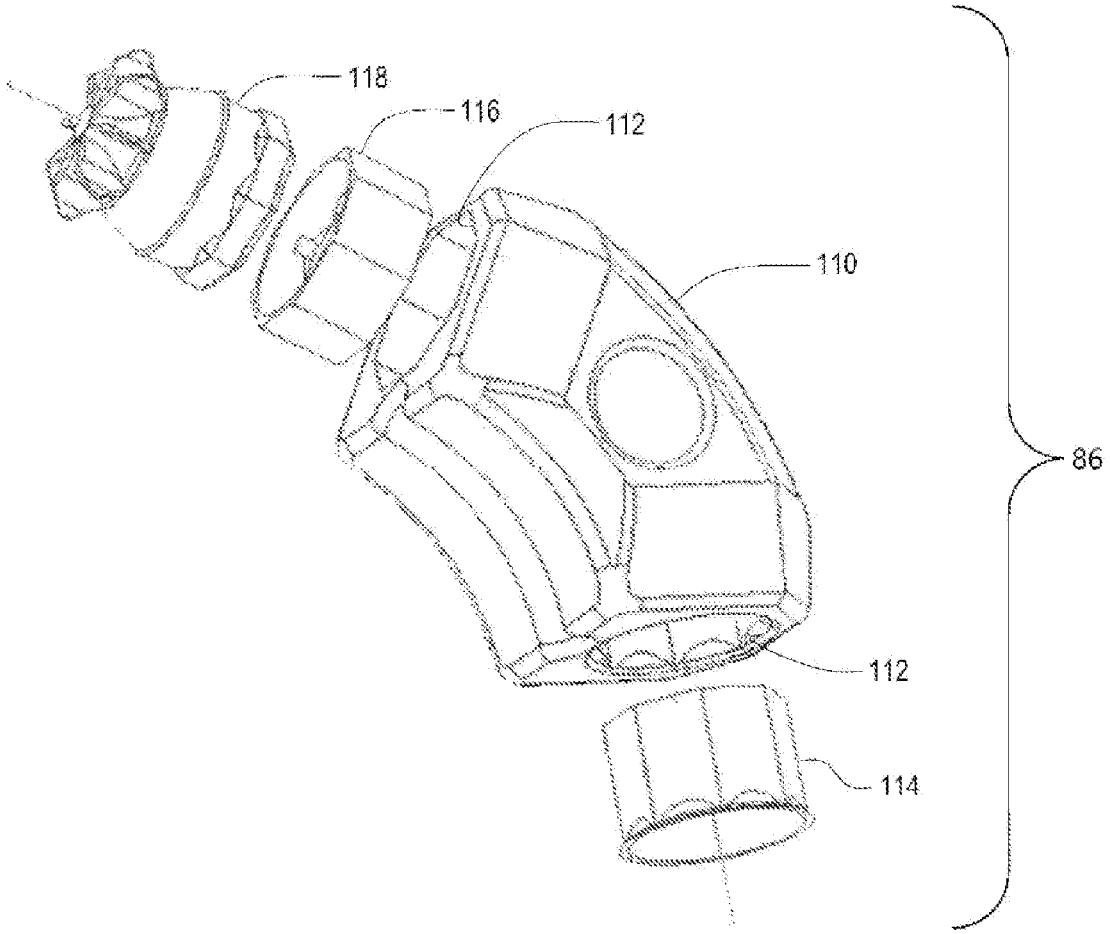
FIG. 14 is a separated perspective of the segment shown in FIG. 11.

Although various methods may be used to manufacture the segments 86, it is envisioned that the segments could be manufactured using additive manufacturing. In the example shown in FIG. 14, the stub connectors 88 would be individually 3D printed using a flexible filament and positioned inside a mold when injection molding the remainder of the segments from foam. In one example, each segment 86 is assembled from four components as shown in FIG. 14. It is envisioned that the segment 86 of this example comprises a body 110 injected molded from a foam material similar to that of the lower ring 26. The body 110 is molded to have a receptacle 112 at each end. One receptacle is adapted to receive molded or additive (3D printed) inserts 114, 116. The first insert 114 is molded or printed plastic and is shaped to form a female connector portion. The second insert 116 is formed to receive a male connector stub 118. In this example, it is envisioned that the inserts 114, 116 are molded. The inserts 114, 116 may be adhesively bonded in a respective receptacle 112 of the body 110 during production, or the inserts may be positioned in the mold when the body is being molded so the inserts become one-piece with the body. In some examples, the base 84 is 3D printed separately using a flexible filament.

Figure 15A:
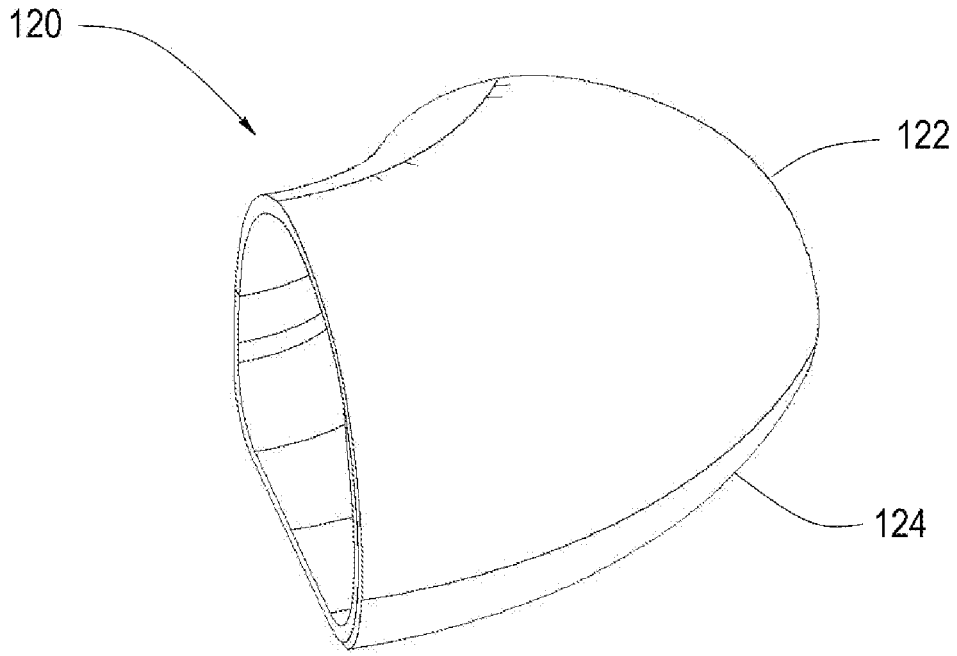
FIG. 15A is a perspective of a covering for the cushion of either example.
Figure 15B:
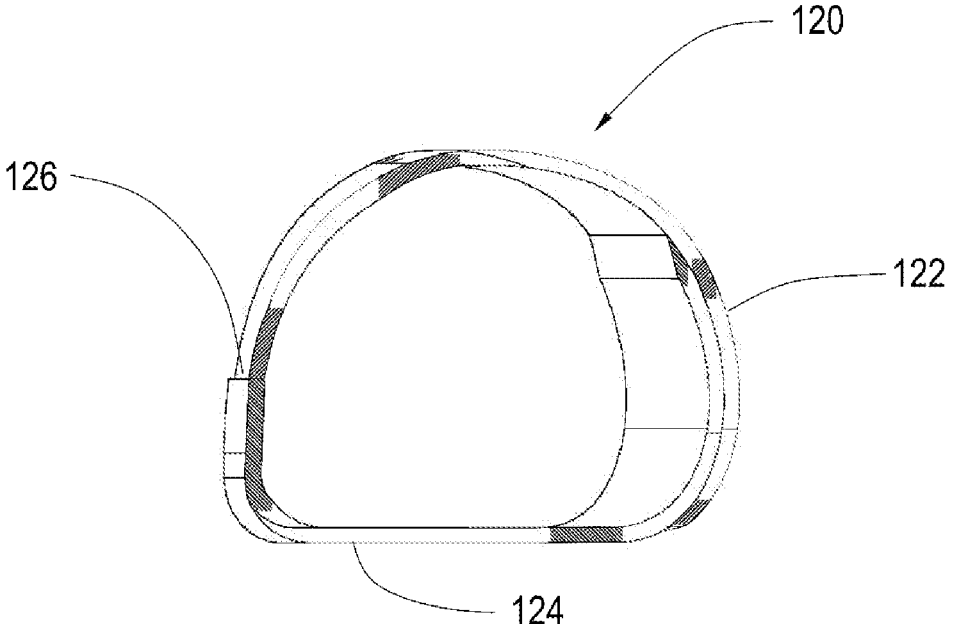
FIG. 15B is a cross section of the covering shown in FIG. 15A.

FIGS. 15A and 15B illustrate a cover segment 120 that may be end joined to cover an upper ring 22 or to cover a pillow assembly 20 or 20'. In the illustrated example, each segment 120 includes an upper portion 122 that covers a top surface of the upper ring or assembly and a lower portion 124 that covers a bottom surface of the upper ring or assembly. The upper portion 122 and lower portion 124 may be integrally constructed as one piece or joined at a seam 126 positioned inside the central opening 28, 28'. The seam 126 may be made using any suitable conventional method such as by sewing or adhesive bonding the upper portion 122 and the lower portion 124. The upper portion 122 overlaps the lower portion 124 on an outer surface of the upper ring or assembly. The overlapping upper and lower portions may be joined using a suitable conventional method. In one example, the overlapping portions are joined using a selectively releasable fastener (e.g., hook-and-loop fasteners), allowing the cover to be removed for cleaning or replacement.

Although the pillow assemblies 20, 20' and constituent elements described above have circular overall shapes, it is envisioned the assemblies and constituent elements may have other shapes. For example, pillow assemblies and elements having generally rectangular, triangular, or oval overall shapes are envisioned. Regardless of their overall shape, it is envisioned that the constituent elements would have central openings for receiving connectors to join the elements to form pillow assemblies.

As various changes could be made to the constructions and methods described herein, it is intended that all matter contained in the above description or shown in the accompanying drawings shall be interpreted as illustrative and not in a limiting sense. The patentable scope of the disclosure is defined by the claims, and can include other constructions and methods that would occur to those skilled in the art. Such other constructions are intended to be within the scope of the claims if the structural elements of the constructions do not differ from the literal language of the claims, or if the constructions include equivalent structural elements having insubstantial differences from the literal languages of the claims.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

To the extent that the specification, including the claims and accompanying drawings, discloses any additional subject matter that is not within the scope of the claims below, the disclosures are not dedicated to the public and the right to file one or more applications to claims such additional disclosures is reserved.

The invention claimed is:

1. A pillow assembly, comprising:

a bottom element having a bottom element upper surface, a bottom element lower surface opposite the bottom element upper surface, and a bottom element central opening extending downward from the bottom element upper surface;

a top element having a top element upper surface, a top element lower surface opposite the top element upper surface lower surface, and a top element central opening extending upward from the top element lower surface, said top element being adapted for positioning in stacked relation with the bottom element so the top element central opening is vertically aligned with the bottom element central opening;

a middle element having a middle element upper surface, a middle element lower surface opposite the middle element upper surface, and a middle element central opening extending through the middle element from the middle element upper surface to the middle element lower surface, said middle element being adapted for positioning between the top element and the bottom element when the top element and bottom element are in stacked relation so the top element central opening, the middle element central opening, and the bottom element central opening are vertically aligned; and an element connector configured for simultaneous receipt in the top element central opening, the middle element central opening, and the bottom element central opening when the middle element is positioned between the top element and the bottom element and the top element and bottom element are in stacked relation to selectively join the top element, the middle element, and the bottom element.

2. A pillow assembly as set forth in claim 1, wherein:

the top element, the middle element, and the bottom element each have generally circular overall shapes;

the top element central opening, the middle element central opening, and the bottom element central opening are each generally circular; and the element connector has a cylindrical portion sized for simultaneous receipt in the top element central opening, the middle element central opening, and the bottom element central opening.

3. A pillow assembly as set forth in claim 2, wherein the top element is sized to support a user's skull without contacting the user's neck when the user's skull is centered on the top element.

4. A pillow assembly as set forth in claim 2, wherein:

the top element central opening has an upward facing land;

the bottom element central opening has a downward facing land;

the element connector has a top flange at a top end of the cylindrical portion and a bottom flange at a bottom end of the cylindrical portion; and the cylindrical portion is sized so the top flange simultaneously engages the upward facing land in the top element central opening and bottom flange engages the downward facing land in the bottom element central opening when top element and the bottom element are stacked so the lower surface of the top element engages the upper surface of the bottom element; and the cylindrical portion is selectively stretchable so the top flange simultaneously engages the upward facing land in the top element central opening and bottom flange engages the downward facing land in the bottom element central opening when the middle element is positioning between the top element and the bottom element and the top element and bottom element are in stacked relation so the top element central opening, the middle element central opening, and the bottom element central opening are vertically aligned.

5. A pillow assembly as set forth in claim 2, wherein:

the top element has a plurality of top element air passages extending through the top element from the top element upper surface to the top element lower surface;

the middle element has a plurality of middle element air passages extending through the middle element from the middle element upper surface to the middle element lower surface; and the bottom element has a plurality of bottom element air passages extending through the bottom element from the bottom element upper surface to the bottom element lower surface.

6. A pillow assembly as set forth in claim 5, wherein:

the top element has a plurality of radially extending top element ridges extending downward from the top element lower surface;

the middle element has a plurality of radially extending middle element grooves extending downward from the middle element upper surface, each of said plurality of middle element grooves being sized and shaped for receiving each of said plurality of top element ridges when the top element is stacked on the middle element so the top element lower surface abuts the middle element upper surface;

the middle element has a plurality of radially extending middle element ridges extending downward from the middle element lower surface; and the bottom element has a plurality of radially extending bottom element grooves extending downward from the bottom element upper surface, each of said plurality of bottom element grooves being sized and shaped for receiving each of said plurality of middle element ridges when the middle element is stacked on the bottom element so the middle element lower surface abuts the bottom element upper surface.

7. A pillow assembly as set forth in claim 6, wherein:

each of said plurality of radially extending top element ridges is identically sized and shaped and each of said plurality of radially extending middle element ridges is identically sized and shaped to each of said plurality of radially extending top element ridges; and each of said plurality of radially extending middle element grooves is identically sized and shaped and each of said plurality of radially extending bottom element grooves is identically sized and shaped to each of said plurality of radially extending middle element grooves.

8. A pillow assembly as set forth in claim 7, wherein each top element air passage of said plurality of top element air passages is vertically aligned with one of said plurality of middle element air passages, and each middle element air passage of said plurality of middle element air passages is vertically aligned with one of said plurality of bottom element air passages when each of said plurality of radially extending top element ridges is seated in a corresponding middle element groove of said plurality of radially extending middle element grooves and each of said plurality of radially extending middle element ridges is seated in a corresponding bottom element groove of said plurality of radially extending bottom element grooves.

9. A pillow assembly, comprising:

a generally circular bottom ring having a bottom ring upper surface, a bottom ring lower surface opposite the bottom ring upper surface, and a generally circular bottom ring central opening extending through the bottom ring from the bottom ring upper surface to the bottom ring lower surface;

a generally circular top ring having a top ring upper surface, a top ring lower surface opposite the top ring upper surface, and a generally circular top ring central opening extending through the top ring from the top ring upper surface to the top ring lower surface;

a middle ring having a middle ring upper surface, a middle ring lower surface opposite the middle ring upper surface, and a middle ring central opening extending through the middle ring from the middle ring upper surface to the middle ring lower surface, said middle ring being adapted for positioning between the top ring and the bottom ring when stacked so the top ring central opening, the middle ring central opening, and the bottom ring central opening are vertically aligned; and a ring connector having a cylindrical portion extending between a top flange and a bottom flange, the cylindrical portion being selectively insertable simultaneously in the bottom ring central opening, the middle ring central opening, and the top ring central opening when the middle ring is positioned between the top ring and the bottom ring and the top ring is stacked above the bottom ring to selectively join the top ring, the middle ring, and the bottom ring.

10. A pillow assembly as set forth in claim 9, wherein when the cylindrical portion is inserted simultaneously in the bottom ring central opening and the top ring central opening, the ring connector top flange engages the top ring and the ring connector bottom flange engages the bottom ring.

11. A pillow assembly as set forth in claim 10, wherein the top flange is recessed below the upper surface of the top ring when the cylindrical portion is inserted in the bottom ring central opening and the top ring central opening, the ring connector top flange engages the top ring, and the ring connector bottom flange engages the bottom ring.

12. A pillow assembly as set forth in claim 10, wherein the top ring is sized to support a user's skull without contacting the user's neck when the user's skull is centered on the top ring.

13. A pillow assembly as set forth in claim 9, wherein:

the bottom ring has a plurality of evenly spaced bottom ring air passages surrounding the bottom ring central opening;

the middle ring has a plurality of evenly spaced middle ring air passages surrounding the middle ring central opening; and the top ring has a plurality of evenly spaced top ring air passages surrounding the top ring central opening.

14. A pillow assembly as set forth in claim 13, wherein at least one of the plurality of evenly spaced top ring air passages is adapted for receiving at least one device selected from a group of devices consisting of a night light, a scent producing device, and an audio device.

15. A pillow assembly as set forth in claim 13, wherein:

the top ring has a plurality of radially extending top ring ridges extending downward from the top ring lower surface;

the middle ring has a plurality of radially extending middle ring ridges extending downward from the middle ring lower surface, each of said middle ring ridges being identically sized, shaped, and arranged to each of said top ring ridges;

the middle ring has a plurality of radially extending middle ring grooves extending downward from the middle ring upper surface, each of said middle ring grooves being sized, shaped, and arranged to receive each of said plurality of top ring ridges to vertically align each of said plurality top ring air passages with a corresponding one of said plurality of middle ring air passages; and the bottom ring has a plurality of radially extending bottom ring grooves extending downward from the bottom ring upper surface, each of said bottom ring grooves being sized, shaped, and arranged to receive each of said plurality of middle ring ridges to vertically align each of said plurality middle ring air passages with a corresponding one of said plurality of bottom ring air passages.

16. A pillow assembly as set forth in claim 15, wherein each of said plurality of top ring air passages, each of said plurality of middle ring air passages, and each of said plurality of bottom ring air passages are equally sized.

17. A pillow assembly as set forth in claim 9, wherein the top ring is more compressible than the middle ring and the bottom ring.

* * * * *